US009152078B2

(12) United States Patent
Sakamaki

(10) Patent No.: US 9,152,078 B2
(45) Date of Patent: Oct. 6, 2015

(54) DEVELOPING APPARATUS

(71) Applicant: CANON KABUSHIKI KAISHA, Tokyo (JP)

(72) Inventor: Tomoyuki Sakamaki, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/554,098

(22) Filed: Nov. 26, 2014

(65) Prior Publication Data

US 2015/0153678 A1 Jun. 4, 2015

(30) Foreign Application Priority Data

Dec. 3, 2013 (JP) ..... 2013-250610
Nov. 18, 2014 (JP) ..... 2014-233796

(51) Int. Cl.
*G03G 15/08* (2006.01)
*G03G 15/09* (2006.01)

(52) U.S. Cl.
CPC ..... *G03G 15/0812* (2013.01); *G03G 15/0921* (2013.01)

(58) Field of Classification Search
CPC ..... G03G 15/0812; G03G 15/08; G03G 15/0815; G03G 15/09; G03G 15/0921
See application file for complete search history.

(56) References Cited

U.S. PATENT DOCUMENTS 6,546,222 B2 4/2003 Sakemi et al.
6,850,722 B2 2/2005 Sakemi et al.
7,853,186 B2 12/2010 Akashi et al.
8,615,187 B2 12/2013 Kunihiro
8,676,099 B2 3/2014 Hattori et al.
2011/0058858 A1* 3/2011 Fukuda et al. ..... 399/272
2011/0206420 A1* 8/2011 Kunihiro ..... 399/274
2011/0217085 A1* 9/2011 Hattori et al. ..... 399/254
2012/0027470 A1* 2/2012 Kunihiro ..... 399/273
2012/0051798 A1* 3/2012 Kunihiro ..... 399/274
2012/0219326 A1* 8/2012 Koike et al. ..... 399/254
2013/0243489 A1 9/2013 Sakamaki

FOREIGN PATENT DOCUMENTS

JP 11-143231 A 5/1999
JP 2011-170294 A 9/2011
JP 2011-185990 A 9/2011
JP 2012-042737 A 3/2012
JP 2012-053126 A 3/2012

OTHER PUBLICATIONS

Tomoyuki Sakamaki et al., U.S. Appl. No. 14/382,404, filed Sep. 2, 2014, (Pub No. US 2015/0104220 A1) Pub date Apr. 16, 2015.

* cited by examiner

*Primary Examiner* — Rodney Bonnette
(74) *Attorney, Agent, or Firm* — Fitzpatrick, Cella, Harper & Scinto

(57) ABSTRACT

A developing apparatus includes a developing sleeve, a regulating member configured to regulate a developer, and first and second chambers forming a circulation route of the developer. A magnet is fixed in the developing sleeve and includes a first magnetic pole, a second magnetic pole having the same polarity as the first magnetic pole, and a third magnetic pole having a different polarity from the second magnetic pole. The second magnetic pole is arranged upstream of an intersection at which a vertical line passing through a rotation center of a first conveying member in the first chamber arranged below the rotation center of the developing sleeve intersects with a lower surface of the developing sleeve.

10 Claims, 4 Drawing Sheets

DEVELOPING APPARATUS

BACKGROUND OF THE INVENTION

1. Field of the Invention

The present invention relates to a developing apparatus to be used in an image forming apparatus such as a copying machine and a laser beam printer using an electrostatic recording process or an electrophotographic process, and configured to develop an electrostatic image formed on an image bearing member with developer including toner and carrier.

2. Description of the Related Art

Hitherto, in image forming apparatus such as a copying machine, an electrostatic latent image formed on a photosensitive drum serving as an image bearing member is developed into a visible image by a developing apparatus.

The developing apparatus is configured to supply toner to the photosensitive drum so as to visualize the latent image as a toner image. A developing apparatus using single-component developer including magnetic toner as developer has been employed, and a developing apparatus using two-component developer obtained by mixing non-magnetic toner and magnetic carrier together has also been employed in many cases. Development of the latent image with the two-component developer is excellent in stability of a toner charge amount, and hence color images can be formed with excellent color tone. For this reason, the two-component developer is suited to use in a color-image forming apparatus.

The developing apparatus includes a regulating blade configured to regulate an amount of developer to be coated onto a developing sleeve serving as a developer carrying member of the developing apparatus. Examples of such a developing apparatus include a developing apparatus of a so-called upper regulation type in which the regulating blade is positioned above the developing sleeve. In this case, there is often employed such a configuration that the developing sleeve is rotated from top to bottom at a facing portion between the developing sleeve and the photosensitive drum.

In addition, there has been proposed a developing apparatus of a so-called lower regulation type in which the regulating blade is positioned below the developing sleeve. In this case, there is often employed such a configuration that the developing sleeve is rotated from bottom to top at the facing portion between the developing sleeve and the photosensitive drum.

In a case where the developing apparatus of the above-mentioned upper regulation type is employed for the photosensitive drum to be rotated from top to bottom at the facing portion between the photosensitive drum and the developing sleeve, the developing sleeve and the photosensitive drum are rotated in the same direction at the facing portion. Thus, such a blank area phenomenon may occur that toner does not adhere to a boundary part between a halftone image portion and a solid image portion. On the other hand, in a case where the developing apparatus of the lower regulation type is employed, the developing sleeve and the photosensitive drum are rotated in directions reverse to each other at the facing portion. Thus, there is an advantage in that the blank area phenomenon does not occur. For this reason, in a case where the blank area phenomenon is conspicuous, such as a case where carrier having relatively high resistance is used, the developing apparatus of the lower regulation type is frequently employed.

Further, the developing apparatus of the above-mentioned lower regulation type is frequently employed, for example, in a case where an intermediate transfer belt is arranged above the photosensitive drum. Specifically, the developing apparatus of the above-mentioned lower regulation type is employed so that the developing sleeve and the photosensitive drum are rotated in the same direction at the facing portion in a case where the photosensitive drum is rotated from bottom to top at the facing portion between the photosensitive drum and the developing sleeve.

The developing apparatus of the above-mentioned lower regulation type is disclosed, for example, in Japanese Patent Application Laid-Open No. H11-143231. FIG. 5 illustrates this developing apparatus.

In a developing apparatus 102 of the above-mentioned lower regulation type, a developing sleeve 120 is provided in a rotatable manner at an opening portion of a developing container 110 containing two-component developer. The developing sleeve 120 is arranged so as to face a photosensitive drum 28, and a cylindrical magnet 121 is arranged in an unrotatable manner at the inside of the developing sleeve 120. At a facing portion between the developing sleeve 120 and the photosensitive drum 28, the developing sleeve 120 is configured to be rotated in a direction reverse to that of the photosensitive drum 28 to be rotated in the direction indicated by the arrow so that the developer attracted and held on a surface of the developing sleeve 120 is conveyed to a developing portion facing the photosensitive drum 28. The magnet 121 has a developing magnetic pole N1 on the side of the photosensitive drum 28. The magnet 121 also has a first conveying magnetic pole S3, a second conveying magnetic pole N2, a stripping magnetic pole S2, and a scooping magnetic pole S1, which serves as a repulsive magnetic pole cooperatively with the stripping magnetic pole S2. Those magnetic poles are formed along a rotation direction of the developing sleeve 120 in an order from the developing magnetic pole N1.

The developer contained in the developing container 110 is carried onto the developing sleeve 120 by an action of the scooping magnetic pole S1 at a position (scooping position) Q on the surface of the developing sleeve 120, which corresponds to the scooping magnetic pole S1 of the magnet 121. The developer carried on the developing sleeve 120 is regulated in layer thickness by a developing blade 122, and then reaches the developing portion. At the developing portion, a magnetic brush is formed by an action of the developing magnetic pole N1 so that the latent image on the photosensitive drum 28 is developed.

The developer on the developing sleeve 120, which is reduced in toner density as a result of the development, is returned into the developing container 110 by being held on the developing sleeve 120 by actions of the first conveying magnetic pole S3 and the second conveying magnetic pole N2. Then, at another position (developer falling position) D on the surface of the developing sleeve 120, at which a magnetic flux density between the stripping magnetic pole S2 and the scooping magnetic pole S1 is low, the developer on the developing sleeve 120 is released to fall. At the scooping position Q, the developing sleeve 120, from which the developer is released, is re-supplied with the developer as described above.

At a position below the developing sleeve 120 inside the developing container 110, a developing chamber 113 including a first agitating-and-conveying member 123 is arranged, and an agitating chamber 114 including a second agitating-and-conveying member 124 is also arranged through intermediation of a partition wall 140. The first agitating-and-conveying member 123 and the second agitating-and-conveying member 124 are each a screw type member, and generally include a helical screw blade 128.

The developer on the developing sleeve 120, which is reduced in toner density, is released to fall onto the first agitating-and-conveying member 123 inside the developing chamber 113. This developer is agitated by the first agitating-and-conveying member 123, and then re-supplied onto the developing sleeve 120 by an action of the scooping magnetic pole S1 of the magnet 121.

At this time, after the developer on the developing sleeve 120, which is reduced in toner density as a result of the development, is released from the developing sleeve 120, the developer may be re-supplied onto the developing sleeve 120 without being sufficiently agitated by the first agitating-and-conveying member 123. In this case, the latent image on the photosensitive drum 28 is developed with the toner which is reduced in toner density. For this reason, image density becomes uneven, resulting in adverse effects such as uneven shading.

As a countermeasure, normally, as illustrated in FIG. 5, in order that the developer released from the developing sleeve 120, which is reduced in toner density, be reliably subjected to an agitating action by the first agitating-and-conveying member 123, the first agitating-and-conveying member 123 and the developing sleeve 120 are rotated in directions reverse to each other at a facing portion therebetween. Further, the developing sleeve 120 is arranged in a manner that a position vertically below the position (scooping position) Q on the surface of the developing sleeve 120, which corresponds to the scooping magnetic pole S1 of the magnet 121, is closer to the developing blade 122 with respect to an axis of the first agitating-and-conveying member 123.

As a configuration for preventing the uneven shading which may be caused by the developer released from the developing sleeve and re-supplied to the developing sleeve without being sufficiently agitated, there has been proposed a developing apparatus of a separate function type as disclosed in Japanese Patent Application Laid-Open No. 2012-42737. The developing apparatus according to Japanese Patent Application Laid-open No. 2012-42737 is an example of a combination of the developing apparatus of the above-mentioned lower regulation type and the separate function type. FIG. 6 illustrates this configuration.

A developing apparatus 31 of the separate function type refers to a developing apparatus of a developer circulation type, in which developer is supplied onto a developing sleeve 3 from a developing chamber 11 including a first agitating-and-conveying member 13, and after the development, the developer is collected into an agitating chamber 12 including a second agitating-and-conveying member 14 without being returned into the developing chamber 11. By employing the separate function type, the developer that is reduced in toner density as a result of the development is prevented from being re-supplied to the developing sleeve 3 without being sufficiently agitated. As a result, the problems such as the above-mentioned uneven shading can be prevented.

However, the developing apparatus 31 of the separate function type as disclosed in Japanese Patent Application Laid-Open No. 2012-42737 has a problem in that a surface of the developer cannot be evenly spread. The problem is caused due to the collection of the developer from the developing sleeve 3 into the agitating chamber 12. Normally, in a configuration for circulating developer in a looped manner between the developing chamber and the agitating chamber, the developer flows only in one direction. Thus, an even amount of the developer can be relatively easily distributed by appropriately designing developing screws. However, in the configuration of the developing apparatus 31 of the separate function type, the developer on the developing sleeve 3 is transported along a longitudinal direction of the agitating chamber 12. Thus, in the developing chamber 11, the developer decreases in amount toward a downstream side in a conveying direction along with supply to the developing sleeve 3. On the other hand, in the agitating chamber 12, the developer increases in amount toward the downstream side in the conveying direction. Thus, the even amount of the developer is difficult to distribute in a longitudinal direction of a developing container 2.

In this way, in the developing apparatus of the separate function type, the developer is liable to stagnate on the downstream side in the agitating chamber and the upstream side in the developing chamber. Thus, the surface of the developer contained in the developing chamber becomes lower from the upstream side toward the downstream side. As a result, an amount of the developer to be supplied to the developing sleeve on the downstream side in the developing chamber decreases. In particular, in the developing apparatus of the lower regulation type, in which the blade configured to regulate a coating amount of the developing sleeve is positioned below the developing sleeve, depending on a position of the scooping magnetic pole S1 of the magnet arranged at the inside of the developing sleeve, coating failure may be caused by influence of the lowered surface of the developer.

SUMMARY OF THE INVENTION

In view of the circumstances, the present invention provides a developing apparatus which suppresses troubles that may be caused by arrangement of magnetic poles in a circumferential direction in a case where a separate function type is employed in a developing apparatus of a lower regulation type.

In order to solve the above-mentioned problem, according to one embodiment of the present invention, there is provided a developing apparatus, comprising:

a developer carrying member provided in a rotatable manner, and configured to carry developer including toner and magnetic carrier so as to develop a latent image;

a regulating member configured to regulate the developer carried on the developer carrying member, the regulating member having a distal end portion facing the developer carrying member and the distal end portion being positioned below a rotation center of the developer carrying member in a gravity direction;

a first chamber formed so as to face a peripheral surface of the developer carrying member, and configured to supply the developer to the developer carrying member;

a second chamber formed so as to face the peripheral surface of the developer carrying member at an upstream side with respect to the first chamber in a rotation direction of the developer carrying member, and configured to collect the developer from the developer carrying member, the second chamber communicating with the first chamber at both end portions of the second chamber so as to form a circulation route for circulating the developer between the first chamber and the second chamber;

a first conveying member provided in a rotatable manner in the first chamber;

a second conveying member provided in a rotatable manner in the second chamber; and a magnet fixed at an inside of the developer carrying member, and configured to generate a magnetic field for causing the developer to be carried on the developer carrying member, the magnet comprising a plurality of magnetic poles including:

a pair of magnetic poles composed of a first magnetic pole and a second magnetic pole, the second magnetic pole having the same polarity as a polarity of the first magnetic pole and being arranged adjacently to the first magnetic pole at a downstream side with respect to the first magnetic pole in the rotation direction of the developer carrying member; and a third magnetic pole having a polarity different from the polarity of the second magnetic pole and being arranged adjacently to the second magnetic pole at the downstream side with respect to the second magnetic pole in the rotation direction of the developer carrying member, the developer carrying member and the first conveying member being arranged at positions overlapping with each other as viewed in a vertical direction, a rotation center of the first conveying member being arranged below the rotation center of the developer carrying member in the gravity direction, the second magnetic pole being arranged, on the peripheral surface of the developer carrying member, at a position on the upstream side in the rotation direction of the developer carrying member with respect to an intersection at which a vertical line passing through the rotation center of the first conveying member intersects with a lower surface of the developer carrying member.

Further features of the present invention will become apparent from the following description of exemplary embodiments with reference to the attached drawings.

DESCRIPTION OF THE EMBODIMENTS

Now, embodiments of the present invention will be described in detail with reference to the drawings.

First Embodiment

Image Forming Apparatus

Figure 1:
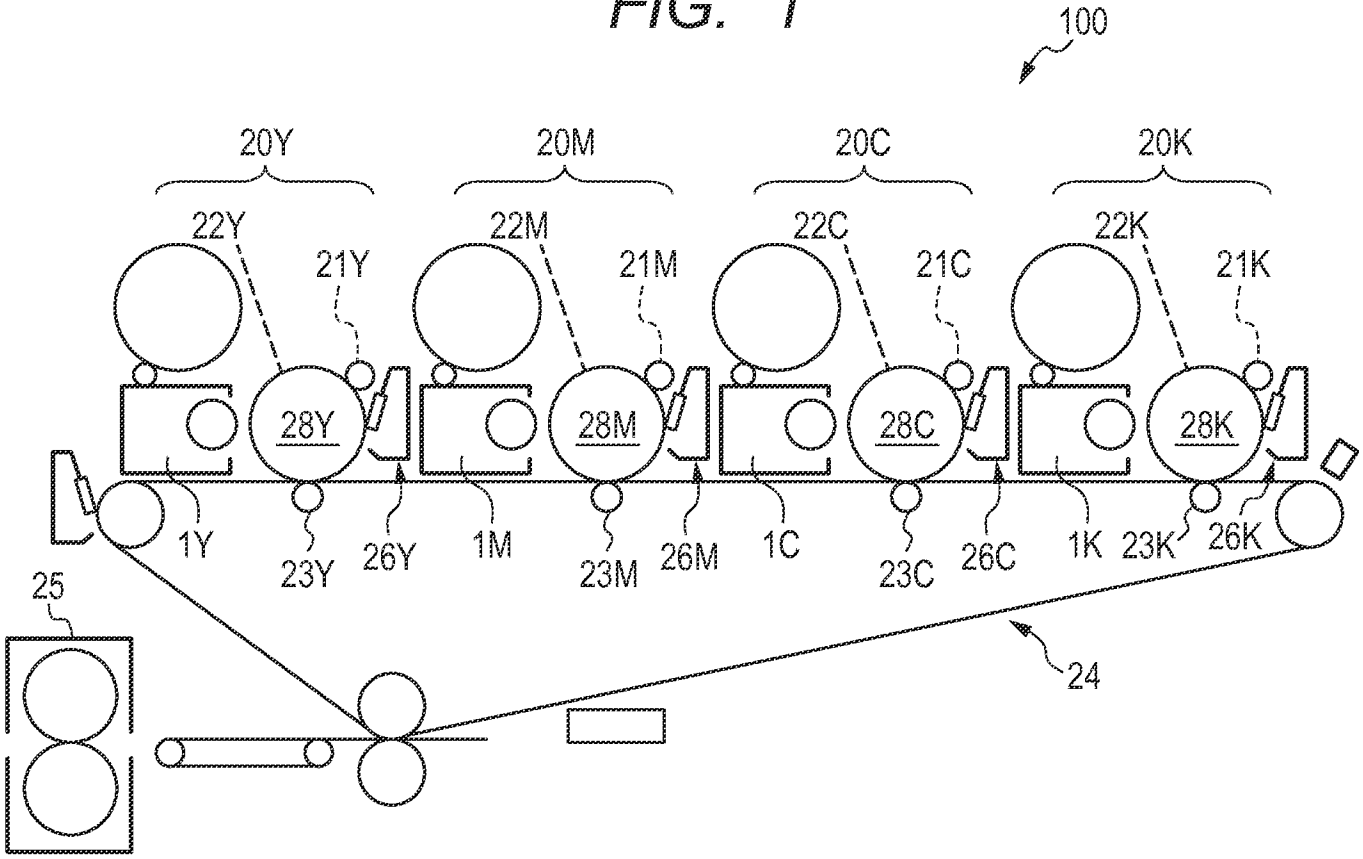
FIG. 1 is a view of an example of an image forming apparatus using a developing device according to the present invention.

As illustrated in FIG. 1, a developing apparatus 1 according to the embodiment is used in a full-color image forming apparatus 100 of a so-called tandem type. The image forming apparatus 100 includes, as image forming portions, a yellow station 20Y, a magenta station 20M, a cyan station 20C, and a black station 20K. Drum cartridges configured to perform toner image forming steps of those four colors, that is, yellow, magenta, cyan, and black, are provided in parallel to each other. Toner images of those four colors are superimposed on each other on an intermediate transfer belt 24, transferred collectively onto a transfer sheet, and then pressurized and heated by a fixing device 25. In this way, a full-color image is obtained. Note that, in the following description, components common to the drum cartridges of yellow, magenta, cyan, and black in FIG. 1 are denoted by reference numerals without suffixes "Y," "M," "C," and "K."

With reference to FIG. 1, a toner image forming operation in each of the drum cartridges will be described. A photosensitive drum 28 serving as an image bearing member is charged by a primary charger 21. A surface of the charged photosensitive drum 28 is exposed with a laser 22. With this, an electrostatic latent image is formed on the photosensitive drum 28, and the latent image is developed by the developing apparatus 1. In this way, toner images are obtained. The toner images are transferred in multiple layers onto the intermediate transfer belt 24 by primary transfer rollers 23. Untransferred residual toner remaining on the photosensitive drum 28 is removed by a cleaner 26.

Developing Apparatus

Figure 2:
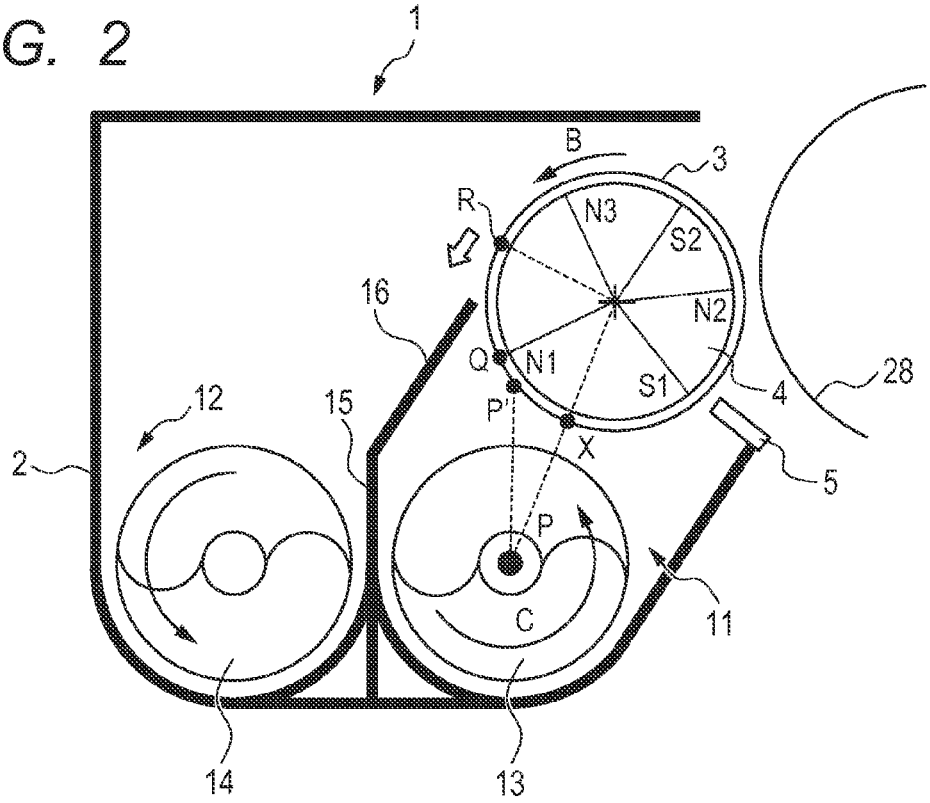
FIG. 2 is a sectional view of a developing device according to a first embodiment, a second embodiment, and a third embodiment.

With reference to FIG. 2, the developing apparatus 1 according to the embodiment (hereinafter also referred to as developing device) will be described in detail. The developing device 1 includes a developing container 2 configured to contain two-component developer, and a developing sleeve 3 provided as a developer carrying member at its opening portion. The developer will now be described. In the embodiment, a two-component developing process is employed as a developing process, and hence non-magnetic toner which is charged to have a negative polarity and magnetic carrier are mixed together and used as the developer. The non-magnetic toner refers to particles which are obtained by crashing or polymerizing resins such as a polyester resin and a styrene acrylic resin which contain colorants, wax components, and the like. The magnetic carrier is obtained by coating a resin onto each of surface layers of cores of resin particles kneaded with ferrite particles and magnetic powder. In the embodiment, toner density in the developer in an initial state (weight % of toner contained in the developer) is set to 8%.

In the developing container 2, a part facing the photosensitive drum 28 is opened, and the developing sleeve 3 is arranged at the opening portion so as to be rotatable in a partially exposed manner. The developing sleeve 3 is made of a non-magnetic material, and includes a fixed built-in magnet roller 4 serving as a magnetic-field generating unit. The magnet roller 4 has a peripheral surface facing the developing sleeve 3, and along the peripheral surface, a plurality of magnetic poles are arranged in a circumferential direction. The developing sleeve 3 is rotated in a direction indicated by the arrow B in FIG. 2 so as to convey developer, which is attracted at a position of a scooping magnetic pole N1 of the magnetic-field generating unit, toward a blade 5. The developer, which is formed into a magnetic brush by a regulating magnetic pole S1, is regulated in amount by receiving a shearing force from the blade 5 serving as a regulating member. When passing through a gap between the developing sleeve 3 and the blade 5, the developer is formed into a developer layer having a predetermined layer thickness on the developing sleeve 3. The blade 5 has a distal end portion which is arranged so as to face the developing sleeve 3 at a position below a rotation center of the developing sleeve 3 in a gravity direction. An amount of the developer to be coated onto the developing sleeve 3 is regulated by the distal end portion of the blade 5. The developer layer is carried and conveyed into a developing region facing the photosensitive drum 28. In a state in which the magnetic brush is formed, the electrostatic latent image formed on the surface of the photosensitive drum 28 is developed by a developing magnetic pole N2. After the development, the developer is stripped off from a surface of the developing sleeve 3 by a pair of magnetic poles (hereinafter also referred to as repulsive magnetic poles) having the same polarity and being formed adjacently to each other. The repulsive magnetic poles, specifically, a stripping magnetic pole N3 and the scooping magnetic pole N1 having the same polarity are adjacent to each other, and hence a non-magnetic region (low-magnetic region) is formed therebetween. In this region, the developer is released from the developing sleeve 3. In the embodiment, a magnetic force of 10 mT or less is generated in the region of the non-magnetic region.

Note that, in the embodiment, positions of the magnetic poles formed in the circumferential direction of the developing sleeve 3 are defined as follows. Specifically, the magnetic poles refer to positions at each of which a component Br of a magnetic flux density in a normal direction reaches a peak (local maximum) in the circumferential direction of the magnet roller 4.

The developing container 2 is partitioned by a partition wall 15 into a developing chamber 11 (first developer containing chamber) and an agitating chamber 12 (second developer containing chamber). The developing chamber 11 and the agitating chamber 12 extend along a rotation-axis direction of the developing sleeve 3. Both ends of the partition wall 15, which do not reach lateral walls of both end portions in a longitudinal direction in an inside of the developing container 2, form a communication portion which allows the developer to pass therethrough between the developing chamber 11 and the agitating chamber 12. In other words, the developing chamber 11 and the agitating chamber 12 communicate to each other at both the end portions so as to form a circulation route for circulating the developer.

The developing chamber 11 and the agitating chamber 12 respectively include a first screw 13 and a second screw 14 serving as agitating-and-conveying members configured to circulate the developer between the developing chamber 11 and the agitating chamber 12. The first screw 13 and the second screw 14 are provided so as to be reverse to each other in conveying direction. The developer is mixed and agitated along with circulation between the developing chamber 11 and the agitating chamber 12. In the embodiment, the first screw 13 and the second screw 14 are provided at positions overlapping with each other as viewed in a horizontal direction. Further, in the embodiment, the first screw 13 and the second screw 14 are provided at such positions that, as viewed in the horizontal direction, a rotation center of at least one of the first screw 13 and the second screw 14 overlaps with a blade of another of the screws. In this way, the first screw 13 and the second screw 14 are arranged substantially horizontally with each other. In comparison with a case where the first screw 13 and the second screw 14 are arranged side by side in a vertical direction, influence that may be caused at the time of conveyance of the developer against the gravity can be reduced. As a result, the developer can be conveyed with higher efficiency. The developing sleeve 3, the first screw 13, and the second screw 14 are configured to be driven in conjunction with each other through respective gear trains (not shown), and also rotated by drive transmitted from a developing device drive gear (not shown). A guide member 16 on the partition wall 15 is arranged close to the developing sleeve 3 in the vicinity of the non-magnetic region of the developing sleeve 3. After the developer on the developing sleeve 3 has been released by the stripping magnetic pole N3, the guide member 16 guides the developer so as to be contained into the agitating chamber 12 without being returned into the developing chamber 11.

As described above, the developing device 1 of such a separate function type has a problem in that a surface of the developer cannot be evenly spread. In this context, features of the embodiment will be described.

Scooping Position of Repulsive Poles

Figure 7:
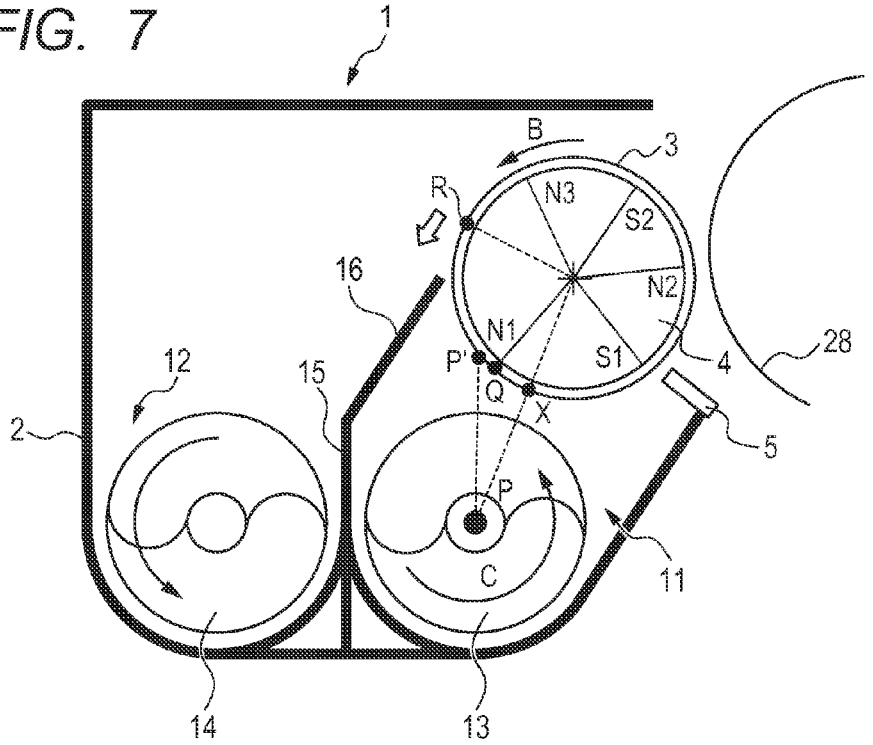
FIG. 7 is a sectional view of a developing device according to the first embodiment and the third embodiment.

In the embodiment, as illustrated in FIG. 7, a position of the scooping magnetic pole N1 (one of the repulsive magnetic poles on a downstream side in a rotation direction of the developing sleeve 3) of the magnet roller 4 is optimized. Specifically, the position of the scooping magnetic pole N1 is set on an upstream side in a rotation direction B of the developing sleeve 3 with respect to a position X on the surface of the developing sleeve 3, which is closest to the first screw 13. More specifically, the position (scooping position) Q on the surface of the developing sleeve 3, which corresponds to the scooping magnetic pole N1, is set on the upstream side in the rotation direction B of the developing sleeve 3 with respect to the position X on the surface of the developing sleeve 3, which is closest to the first screw 13. Note that, the position X on the surface of the developing sleeve 3, which is closest to the first screw 13, refers to an intersection between the developing sleeve 3 and a line connecting the rotation center of the developing sleeve 3 and a rotation center P of the first screw 13 to each other.

Note that, in the embodiment, of the repulsive magnetic poles N1 and N3, the magnetic pole N1 on the downstream side in the rotation direction B of the developing sleeve 3 serves as a scooping magnetic pole configured to scoop (supply) the developer to the developing sleeve.

Figure 3:
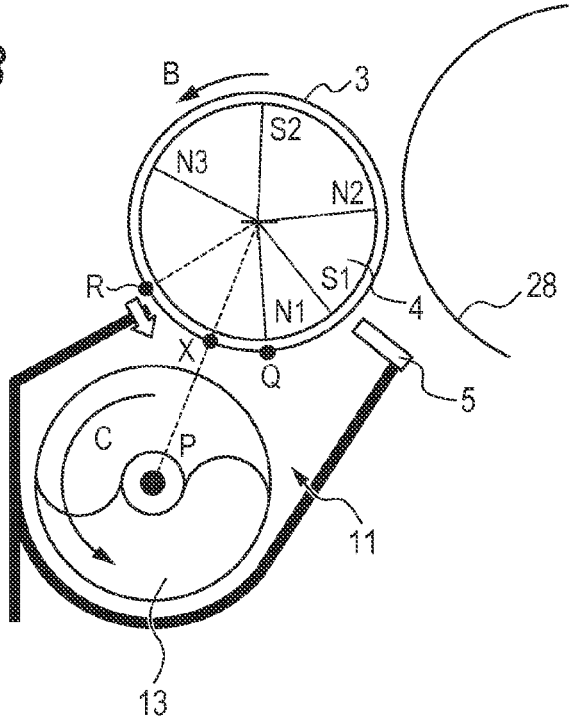
FIG. 3 is an explanatory sectional view of a comparative example.

FIG. 3 illustrates, as a comparative example, a configuration in which the scooping position Q on the surface of the developing sleeve 3, which corresponds to the scooping magnetic pole N1, is set on the downstream side in the rotation direction B of the developing sleeve 3 with respect to the position X closest to the first screw 13. In a case of such a configuration, the closest position X, at which a scooping effect by upward splashing by the first screw 13 is likely to be exerted during a process of scooping the developer to the developing sleeve 3, is arranged in the non-magnetic region between the stripping magnetic pole N3 and the scooping magnetic pole N1. Thus, the scooping effect by upward splashing by the first screw 13 cannot be sufficiently exerted.

In contrast to the comparative example of FIG. 3, in the embodiment illustrated in FIG. 7, the position X closest to the first screw 13 is arranged in a magnetic region between the scooping magnetic pole N1 and the regulating magnetic pole S1. Thus, the developer thrown up by the first screw 13 can be effectively held with a magnetic force. In this way, the scooping effect can be sufficiently exerted.

With this, even in the case where the surface of the developer in the developing chamber 11 is unevenly spread due to employment of the separate function type, in particular, the surface of the developer is lowered on the downstream side in the developing chamber 11, the developer thrown up by the first screw 13 can be effectively held on the developing sleeve 3 with the magnetic force. With this, coating failure can be overcome.

Figure 5:
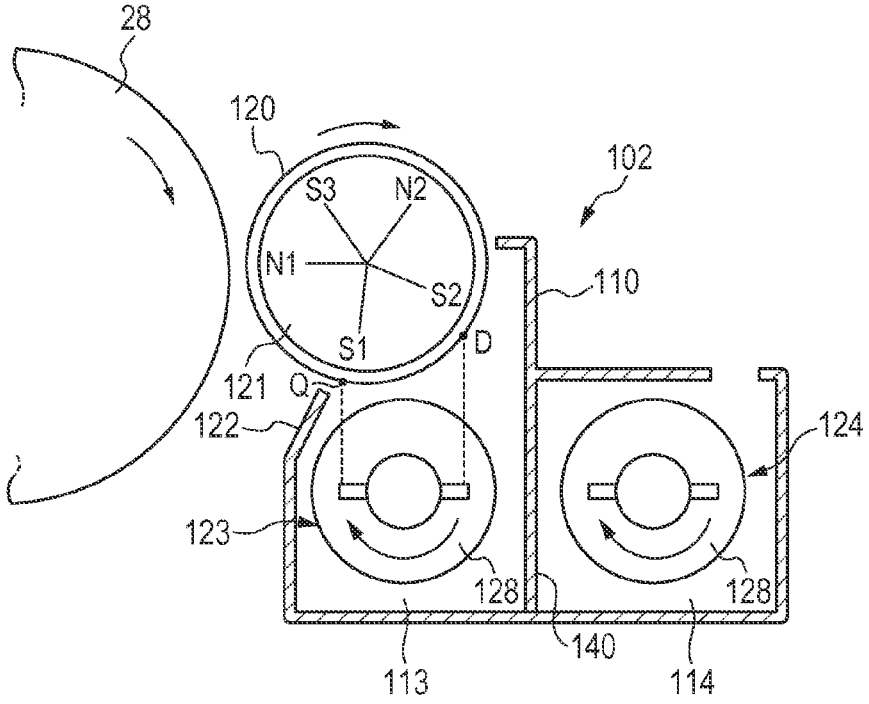
FIG. 5 is an explanatory sectional view of the conventional art.
Figure 6:
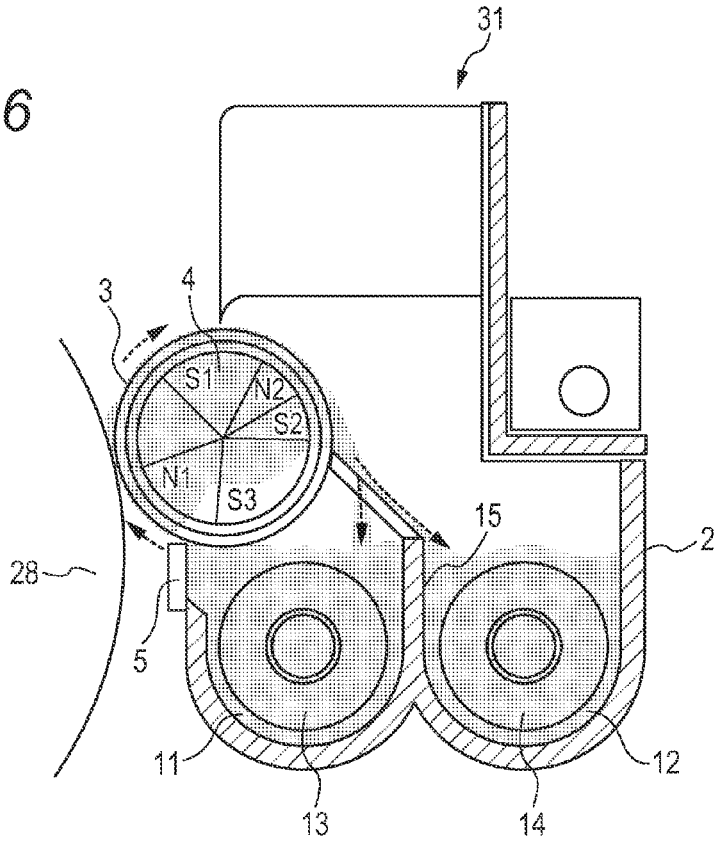
FIG. 6 is another explanatory sectional view of the conventional art.

Note that, as described at the beginning of the conventional art, in the developing apparatus 102 (FIG. 5) not employing the separate function type, when the scooping magnetic pole N1 is provided on the further upstream side as in the embodiment of the present invention, problems such as image density unevenness and uneven shading are more liable to occur. This is because, after the developer on the developing sleeve 120, which is reduced in toner density, is released, the developer is liable to be re-supplied onto the developing sleeve 120 without being sufficiently agitated by the first agitating-and-conveying member 123. However, as in the embodiment, in the case where the developing apparatus 1 employs the separate function type, the developer on the developing sleeve 3, which is reduced in toner density, is released and collected not into the developing chamber 11 but into the agitating chamber 12. With this, the developer is sufficiently agitated, and then re-supplied onto the developing sleeve 3.

Second Embodiment

In the embodiment, a more preferred position of the scooping magnetic pole is specified. Other configuration features than the arrangement of the scooping magnetic pole are the same as those in the first embodiment, and hence are not described in detail. In the embodiment, only the differences from the first embodiment will be described.

In the embodiment, as illustrated in FIG. 2, on the surface of the developing sleeve 3, the scooping position Q is arranged on the upstream side in the rotation direction B of the developing sleeve 3 with respect to a position P' vertically above the rotation center P of the first screw 13. Specifically, the scooping position Q is arranged on the upstream side in the rotation direction B of the developing sleeve 3 with respect to the position (intersection) P' at which a vertical line passing through the rotation center P of the first screw 13 intersects with a lower surface of the developing sleeve 3. With this, the developer can be more effectively scooped.

Now, the more preferred position of the scooping magnetic pole will be described in detail. In the embodiment, the first screw 13 is rotated in a rotation direction C which is the same as the rotation direction B of the developing sleeve 3. In such a case, in the right half with respect to the rotation center P of the first screw 13, the blade of the screw 13 is rotated from bottom to top, and hence the developer is thrown upward in the right half. Thus, in the case where the developing sleeve 3 is provided above the first screw 13 as in the embodiment, it is preferred that the entire region of the right half with respect to the rotation center P of the first screw 13, in which the developer is thrown upward, overlap with a magnetic region generated by the magnet roller 4.

Note that, in order to reliably overlap the entire region of the right half with the magnetic region, displacement of the positions of the magnetic poles of the magnet roller 4 needs to be taken into consideration. This is because center positions of the magnetic poles, which are designed to overlap with the entire region of the right half, may not overlap therewith due to the displacement. Thus, it is preferred that the scooping position Q be arranged, at least at an angle corresponding to the displacement, further on the upstream side in the rotation direction B of the developing sleeve 3 with respect to the position P' at which the vertical line passing through the rotation center P of the first screw 13 intersects with the lower surface of the developing sleeve 3. In the embodiment, a tolerance of manufacturing variations of the scooping position Q of the magnet roller 4 is Δ6°. Furthermore, a tolerance in mounting a pole setting sheet metal (not shown) configured to fix the magnet roller 4 to a body of the developing device 1 is Δ2°. Specifically, the tolerance Δ6° represents from a case of an upper limit value +6° and a lower limit value −0° of a shift of the scooping position Q with respect to a designed reference position on the upstream side in the rotation direction B of the developing sleeve 3 to a case of an upper limit value +0° and a lower limit value −6° of a shift thereof on the downstream side. In other words, the tolerance Δ6° represents a difference of 6° between the upper limit value and the lower limit value with respect to the reference position. A tolerance Δ2° represents from a case of an upper limit value +2° and a lower limit value −0° of a shift of a mounting position of the magnet roller 4 with respect to the designed reference position on the upstream side in the rotation direction B of the developing sleeve 3 to a case of an upper limit value +0° and a lower limit value −2° of a shift thereof on the downstream side. Thus, in the embodiment, the scooping position Q may be displaced at ±8° with respect to the designed reference position. In a case where the scooping position Q is displaced on the downstream side in the rotation direction B of the developing sleeve 3, a part of the region of the right half with respect to the rotation center P of the first screw 13 may not overlap with the magnetic region generated by the magnet roller 4. Thus, in the embodiment, in consideration of the tolerances, the scooping position Q is set to a position at an angle equal to or more than a sum of the tolerances (8°), specifically, at 10° on the upstream side in the rotation direction B of the developing sleeve 3 with respect to the position P' at which the vertical line passing through the rotation center P of the first screw 13 intersects with the lower surface of the developing sleeve 3. In the case where the scooping position Q is set to the position on the upstream side at the angle equal to or more than the sum of the tolerances, even when the manufacturing variations occur, the entire region of the right half with respect to the rotation center P of the first screw 13 can be reliably overlapped with the magnetic region generated by the magnet roller 4. Note that, also in a case where the scooping position Q is set to a position at an angle at least half of the sum of the tolerances on the upstream side (4° in the embodiment), the scooping effect can be exerted to some extent. This is because, with regard to the tolerances which are set in consideration of the risk that the scooping position Q is displaced to both the upstream side and the downstream side in the rotation direction B of the developing sleeve 3, the displacement to the downstream side rather has influence. In order to reliably exert the scooping effect, it is only necessary to set in advance the scooping position Q on the upstream side at the angle equal to or larger than the sum of the tolerances. Practically, it is preferred that the sum of the tolerances be suppressed to 16° or less, which can be easily achieved even with the conventional art. Thus, it is conceived that the advantages of the present invention can be sufficiently obtained as long as the scooping position Q is set to a position at least at 16° on the upstream side in the rotation direction B of the developing sleeve 3 with respect to the position P' at which the vertical line passing through the rotation center P of the first screw 13 intersects with the lower surface of the developing sleeve 3. Based on the idea of the half of the sum of the tolerances described above, it is conceived that the scooping effect can be exerted to some extent also in a case where the scooping position Q is set to a position at least at 8° on the upstream side.

Such a configuration is advantageous in the case where the developing sleeve 3 is provided above the first screw 13. The scooping effect can be exerted as long as a lower rim of the developing sleeve 3 is positioned at least above the rotation center P of the first screw 13. As in the embodiment, when the lower rim of the developing sleeve 3 is positioned above an upper rim of the first screw 13, the scooping effect becomes greater.

Third Embodiment

Local Minimum Position R of Magnetic Flux Density Br in Non-Magnetic Region

In the embodiment, as illustrated in FIG. 2, in the non-magnetic region formed between a pair of magnetic poles, a local minimum position R at which the component Br of the magnetic flux density in the normal direction with respect to the developing sleeve 3 reaches a local minimum is optimized. With this, the developer is suppressed from trailing along the developing sleeve 3. Specifically, the local minimum position R of the component Br of the magnetic flux density in the normal direction in the non-magnetic region is arranged above the rotation center of the developing sleeve 3. Thus, the developer stripped off from the developing sleeve 3 can be smoothly guided into the agitating chamber 12. Now, this configuration will be described in detail.

In the embodiment, as illustrated in FIG. 2, the guide member 16 on the partition wall 15 is close to the developing sleeve 3 near the non-magnetic region of the developing sleeve 3. The guide member 16 is configured to guide the developer so as to cause the developer on the developing sleeve 3, which has been released by the stripping magnetic pole N3, not to be returned into the developing chamber 11 but to be received into the agitating chamber 12. When the guide member 16 is arranged near the local minimum position R of the magnetic flux density (component in the normal direction) Br in the non-magnetic region of the developing sleeve 3, the stripped developer can be efficiently collected.

In the embodiment, a rotation center of the second screw 14 in the agitating chamber 12 is arranged vertically below the rotation center of the developing sleeve 3. At this time, when the local minimum position R of the magnetic flux density (component in the normal direction) Br is arranged above the rotation center of the developing sleeve 3, a force in a tangential direction of the developing sleeve 3 is applied at the position R to the developer, and hence the developer is caused to flow into the agitating chamber 12 (in a direction indicated by the hollow arrow in FIG. 7). Thus, the stripped developer is smoothly moved to the guide member 16, and hence can be easily moved into the agitating chamber 12. In the configuration of the embodiment, the scooping magnetic pole N1 is arranged at a relatively upstream position in the rotation direction B of the developing sleeve 3, and hence the local minimum position R of the magnetic flux density can be easily set above the rotation center of the developing sleeve 3.

On the other hand, in the case of the comparative example illustrated in FIG. 3, the scooping magnetic pole N1 is arranged at a relatively downstream position in the rotation direction B of the developing sleeve 3, and hence the local minimum position R of the magnetic flux density is arranged below the rotation center of the developing sleeve 3. In this case, the force to be applied at the position R to the developer is directed toward the developing chamber 11 (direction indicated by the hollow arrow in FIG. 3). Thus, the stripped developer may be mixed into the developing chamber 11 through a gap between the guide member 16 and the developing sleeve 3, which may cause uneven shading.

In the configuration of the embodiment, such risks can be reduced.

Further, when the local minimum position R of the magnetic flux density (component in the normal direction) Br is arranged above the rotation center of the developing sleeve 3 as in the embodiment illustrated in FIG. 2, a slope of the guide member 16 may be formed at an angle steeper than that in the case where the local minimum position R is arranged below the rotation center as in the comparative example illustrated in FIG. 3. The guide member 16 is configured to convey the developer in a manner that the developer is slid down along a slope at a given angle. Thus, as the angle is steeper, risks that may be caused by a mild angle, such as developer stagnation, can be reduced.

Note that, in order to arrange the local minimum position R of the magnetic flux density (component in the normal direction) Br reliably above the rotation center of the developing sleeve 3, also in this case, the displacement of the positions of the magnetic poles of the magnet roller 4 needs to be taken into consideration. The local minimum position R of the magnetic flux density (component in the normal direction) Br may be displaced due to displacement of the two magnetic poles (N1 and N3) as the repulsive magnetic poles. As a countermeasure, also in the case, similarly to the scooping position Q in the case described above, it is only necessary to set in advance the local minimum position R further on the upstream side at an angle equal to or larger than a larger one of tolerances of the two magnetic poles (N1 and N3). In the embodiment, the tolerance of the scooping magnetic pole N1 is Δ8°, and the tolerance of the stripping magnetic pole N3 is Δ8° as well. Thus, in advance, the local minimum position R is set to a position at 10° or more, that is, the position is set at 8° or more. Also in a case where the local minimum position R is set to a position at an angle at least half of any one of the tolerances on the upstream side (4° in the embodiment), the effect can be exerted to some extent. Practically, it is preferred that the tolerance be suppressed to 16° or less, which can be easily achieved even with the conventional art. Thus, it is conceived that the advantages of the present invention can be sufficiently obtained as long as the local minimum position R is set to the position at least at 16° on the upstream side. Based on the idea of the half of the tolerances described above, it is conceived that the effect can be exerted to some extent also in the case where the local minimum position R is set to a position at least at 8° on the upstream side.

Fourth Embodiment

In the embodiment, the first screw 13 is rotated in a rotation direction different from that in the first embodiment. Outlines of the image forming apparatus and the developing apparatus are the same as those in the first embodiment, and hence descriptions thereof are omitted. In the embodiment, configuration features that are different from those in the first embodiment will be described.

Figure 4:
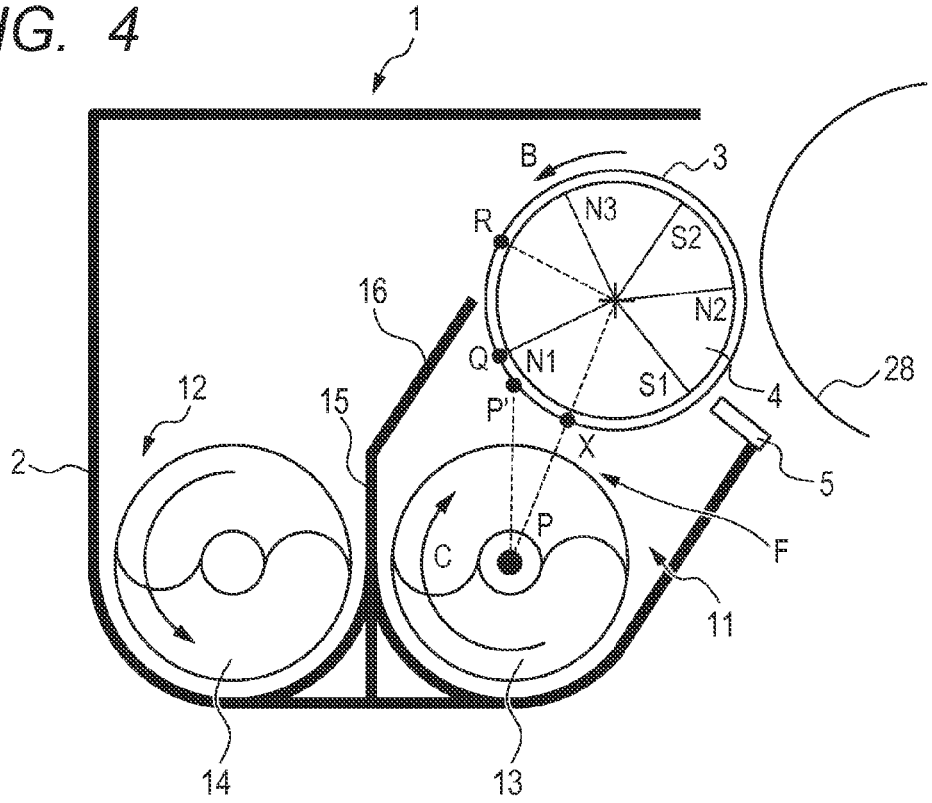
FIG. 4 is a sectional view of a developing device according to a fourth embodiment of the present invention.

As illustrated in FIG. 4, in the embodiment, the first screw 13 is rotated in a rotation direction reverse to that in the first embodiment. Specifically, the rotation direction C of the first screw 13 and the rotation direction B of the developing sleeve 3 are the same as each other at a facing portion F between the first screw 13 and the developing sleeve 3.

Note that, also in the embodiment, the position (scooping position) Q on the surface of the developing sleeve 3, which corresponds to the scooping magnetic pole N1 of the magnet roller 4, is set on the upstream side in the rotation direction B of the developing sleeve 3 with respect to the closest position X on the surface of the developing sleeve 3, the closest position X being closest to the first screw 13. With this, the closest position X to the first screw 13 is arranged in the magnetic region between the scooping magnetic pole N1 and the regulating magnetic pole S1. Thus, as in the case of the first embodiment, the developer thrown up by the first screw 13 can be effectively held with a magnetic force. In this way, the scooping effect can be sufficiently exerted.

In the embodiment, in the left half with respect to the rotation center P of the first screw 13, the blade of the screw 13 is rotated from bottom to top, and hence the developer is thrown upward in the left half. Thus, when even a small part of the region of the left half with respect to the rotation center P of the first screw 13, in which the developer is thrown upward, overlaps with the magnetic region generated by the magnet roller 4, the developer can be effectively scooped. For this reason, in the embodiment, the scooping position Q is arranged on the upstream side in the rotation direction B of the developing sleeve 3 with respect to the position P' on the surface of the developing sleeve 3, which is vertically above the rotation center P of the first screw 13. In contrast, in a case where the scooping position Q is arranged on the downstream side in the rotation direction B of the developing sleeve 3 with respect to the position P', the region of the left half with respect to the rotation center P of the first screw 13 does not overlap with the magnetic region generated by the magnet roller 4. As a result, scooping efficiency is significantly deteriorated.

Also with such a configuration, even in the case where the surface of the developer in the developing chamber 11 is unevenly spread due to employment of the separate function type, the developer thrown up by the first screw 13 can be effectively held on the developing sleeve 3 with the magnetic force. With this, coating failure can be overcome.

Further, also in the embodiment, as in the third embodiment, the position R at which the magnetic flux density reaches a local minimum is arranged above a position of the rotation center of the developing sleeve 3. With this configuration, while the developer is suppressed from trailing along the developing sleeve 3, the developer is stripped off and smoothly guided into the agitating chamber 12.

Modifications

In the examples described in the embodiments, the non-magnetic region is generated by a pair of magnetic poles which have the same polarity and are provided adjacently to each other (in the embodiments, stripping magnetic pole N3 and scooping magnetic pole N1). However, the present invention is not limited to this configuration. For example, a magnetic pole that has a reverse polarity and generates a magnetic force that is low enough to be regarded as substantially zero may be interposed between the stripping magnetic pole N3 and the scooping magnetic pole N1. In the present invention, a magnetic force of 10 mT or less is regarded as substantially zero. In the present invention, such a configuration in which the magnetic pole that has a reverse polarity and generates a significantly low magnetic force is interposed between the repulsive magnetic poles is also defined as the configuration including a pair of magnetic poles which have the same polarity and are provided adjacently to each other.

Further, the two screws, which are arranged horizontally with each other in the cases described in the embodiments, need not necessarily be arranged horizontally with each other.

Still further, the configurations of the first to fourth embodiments may be employed in combination with each other as necessary.

The developing apparatus according to the configurations of the embodiments is configured to suppress troubles such as coating failure and uneven shading, which may be caused depending on arrangement in a circumferential direction of magnetic poles in a case where a separate function type is employed in a developing apparatus of a lower regulation type.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-250610, filed Dec. 3, 2013, and Japanese Patent Application No. 2014-233796, filed Nov. 18, 2014, which are hereby incorporated by reference herein in their entirety.

What is claimed is:

1. A developing apparatus, comprising:

a developer carrying member provided in a rotatable manner, and configured to carry developer including toner and magnetic carrier so as to develop a latent image;

a regulating member configured to regulate the developer carried on the developer carrying member, the regulating member having a distal end portion facing the developer carrying member and the distal end portion being positioned below a rotation center of the developer carrying member in a gravity direction;

a first chamber provided so as to face a peripheral surface of the developer carrying member, and configured to supply the developer to the developer carrying member;

a second chamber provided so as to face the peripheral surface of the developer carrying member at an upstream side with respect to the first chamber in a rotation direction of the developer carrying member, and configured to collect the developer from the developer carrying member, the second chamber communicating with the first chamber at both end portions of the second chamber so as to form a circulation route for circulating the developer between the first chamber and the second chamber;

a first conveying member provided in a rotatable manner in the first chamber;

a second conveying member provided in a rotatable manner in the second chamber; and a magnet fixed inside of the developer carrying member, and configured to generate a magnetic field for causing the developer to be carried on the developer carrying member, the magnet comprising a plurality of magnetic poles including:

a pair of magnetic poles composed of a first magnetic pole and a second magnetic pole, the second magnetic pole having the same polarity as a polarity of the first magnetic pole and being arranged adjacently to the first magnetic pole at a downstream side with respect to the first magnetic pole in the rotation direction of the developer carrying member; and a third magnetic pole having a polarity different from the polarity of the second magnetic pole and being arranged adjacently to the second magnetic pole at the downstream side with respect to the second magnetic pole in the rotation direction of the developer carrying member, the developer carrying member and the first conveying member being arranged at positions overlapping with each other as viewed in a vertical direction, a rotation center of the first conveying member being arranged below the rotation center of the developer carrying member in the gravity direction, the second magnetic pole being arranged, on the peripheral surface of the developer carrying member, at a position on the upstream side in the rotation direction of the developer carrying member with respect to an intersection at which a vertical line passing through the rotation center of the first conveying member intersects with a lower surface of the developer carrying member.

2. A developing apparatus according to claim 1, wherein the second magnetic pole comprises a scooping magnetic pole configured to scoop the developer from the first chamber to the developer carrying member.

3. A developing apparatus according to claim 1, wherein the second magnetic pole is provided upstream of the intersection in the rotation direction of the developer carrying member at an angle including an angle corresponding to a tolerance of the position of the second magnetic pole.

4. A developing apparatus according to claim 1, wherein the rotation direction of the developer carrying member and a rotation direction of the first conveying member are the same as each other at a facing portion between the developer carrying member and the first conveying member.

5. A developing apparatus according to claim 1, wherein a position at which a component of a magnetic flux density in a normal direction of the developer carrying member reaches a local minimum, the magnetic flux density being generated on the peripheral surface of the developer carrying member between the pair of magnetic poles, is arranged above the rotation center of the developer carrying member.

6. A developing apparatus according to claim 1, further comprising a guide portion configured to guide the developer stripped off from the developer carrying member into the second chamber, wherein a position at which the guide portion faces the developer carrying member is arranged downstream of a position at which a component of a magnetic flux density in a normal direction of the developer carrying member reaches a local minimum in the rotation direction of the developer carrying member, the magnetic flux density being generated on the peripheral surface of the developer carrying member between the pair of magnetic poles.

7. A developing apparatus according to claim 1, wherein the second magnetic pole is provided at a position upstream of the intersection by 16° or more.

8. A developing apparatus according to claim 1, wherein the second magnetic pole is provided at a position upstream of the intersection by 8° or more.

9. A developing apparatus according to claim 1, wherein the second magnetic pole is provided at a position upstream of the intersection by 4° or more.

10. A developing apparatus according to claim 1, wherein the first conveying member and the second conveying member are provided at positions overlapping with each other as viewed in a horizontal direction.

* * * * *